US006049985A

United States Patent [19]

Gonzalez et al.

[11] Patent Number: 6,049,985

[45] Date of Patent: Apr. 18, 2000

[54] DETONATING CORD CUTTER

[75] Inventors: Manuel T. Gonzalez, Sugar Land; James C. Oliver, Houston; Andrew T. Werner, East Bernard; Klaus B. Huber, Sugar Land, all of Tex.

[73] Assignee: Schlumberger Technology Corporation, Sugar Land, Tex.

[21] Appl. No.: 09/128,951

[22] Filed: Aug. 5, 1998

[51] Int. Cl.[7] ..... B26B 13/06

[52] U.S. Cl. ..... 30/233; 30/258

[58] Field of Search ..... 30/191, 186, 233, 30/258, 254, 330, 278, 179, 175, 134

[56] References Cited

U.S. PATENT DOCUMENTS 3,840,989 10/1974 Hexdall ..... 30/233 X 4,271,593 6/1981 Smith ..... 30/233

4,434,555 3/1984 Stoll ..... 30/258 X 5,046,252 9/1991 Ayuta et al. ..... 30/258

*Primary Examiner*—Douglas D. Watts

*Attorney, Agent, or Firm*—Jeffrey E. Griffin; Jaime A. Castano; John R. Ryberg

[57] ABSTRACT

A cutter for cutting a detonating cord comprises a first jaw and a second jaw that are pivotable relative to each other. An anvil is mounted on the second jaw and has a first opening for receiving a cord and a second opening intersecting with the first opening. A blade is mounted on the second jaw and has a cutting edge that is arranged to slide into the second opening when the first and second jaws are pivoted toward each other.

10 Claims, 4 Drawing Sheets

DETONATING CORD CUTTER

BACKGROUND OF THE INVENTION

1. Technical Field

The invention relates generally to a detonating system having a detonation cord for propagating a detonation wave. More particularly, the invention relates to a method and apparatus for cutting a detonating cord.

2. Background Art

A detonating cord is a waterproof, flexible fabric tube or sheath containing an explosive designed to transmit a detonation wave. Typically, the detonating cord is wound on a supply spool and a desired length of the cord is cut as needed. It is important to obtain a square cut at the desired length of the detonating cord to ensure even detonation. One method that has been employed for a long time involves the use of a wooden block and a sharp razor blade to cut the detonating cord. However, this method does not always provide an accurate and quality cut, especially with the new types of sheathing, e.g., "Halar" and "Kevlar" braid sheathing, that are being used on detonating cords today. FIGS. 1A and 1B show another cutter 100 that is sometimes used in cutting a detonating cord. The cutter 100 includes a plier 102 having a pair of jaws 104 and a blade 106 mounted on one of the jaws. A detonating cord may be inserted between the jaws 104 and the jaws 104 may be pivoted toward each other to cut the cord. The cutter 100 is primarily designed for cutting plastic tubing and, therefore, does not usually provide enough support to the detonating cord to prevent the cut end of the detonating cord from becoming oval. In addition, the blade, when used in cutting a detonating cord, typically does not last for more than a couple of cuts. The plier 102 also does not provide adequate mechanical advantage to allow multiple cuts to be made quickly. Therefore, a need still exists for a cutter that can cut a detonating cord safely, accurately, and efficiently.

SUMMARY OF THE INVENTION

In general, in one aspect, a cord cutter comprises a first jaw and a second jaw. The first jaw and second jaw are pivotable relative to each other. An anvil mounted on the second jaw has a first opening for receiving a cord and a second opening intersecting with the first opening. A blade mounted on the first jaw has a cutting edge that is arranged to slide into the second opening when the first jaw and second jaw are pivoted toward each other.

Other features and advantages of the invention will be apparent from the following description and the appended claims.

DESCRIPTION OF THE PREFERRED EMBODIMENT

Figure 1A:
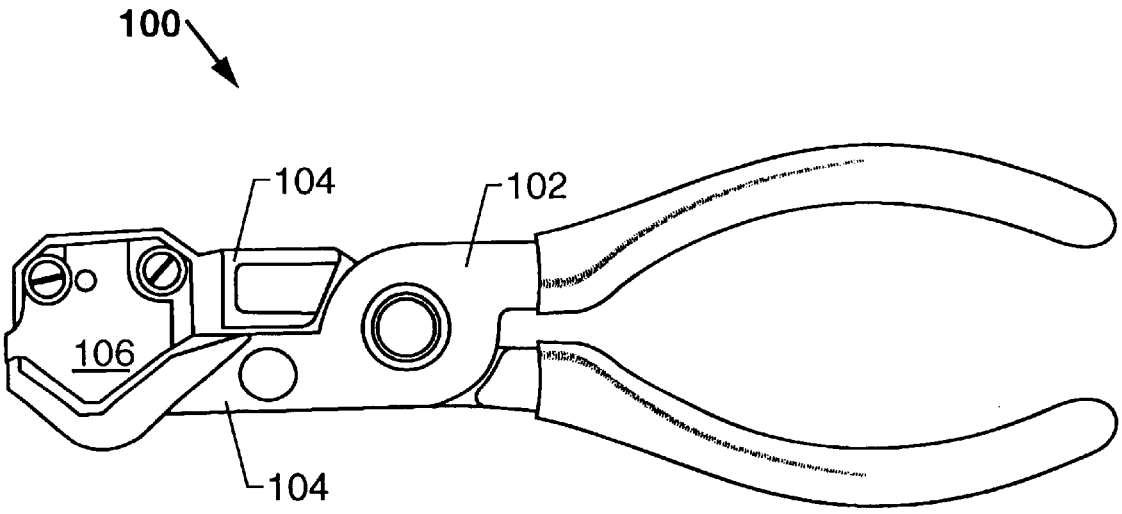
FIG 1A (Prior Art)
FIGS. 1A and 1B show a prior art tubing string cutter.
Figure 1B:
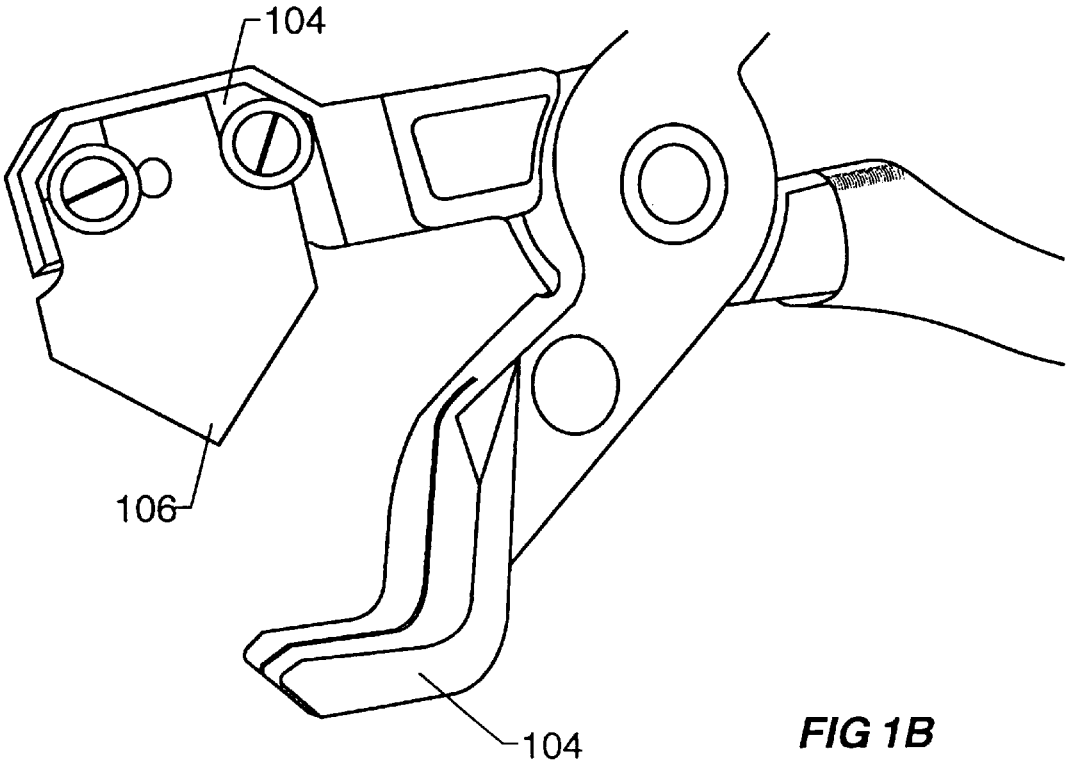
FIG 1B (Prior Art)
Figure 2A:
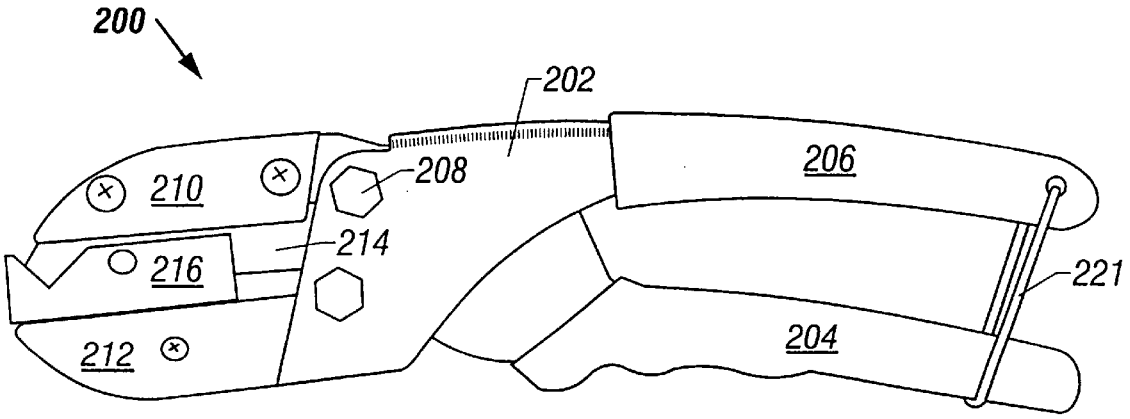
FIGS. 2A and 2B are side views of a cord cutter in the closed and open positions.
Figure 2B:
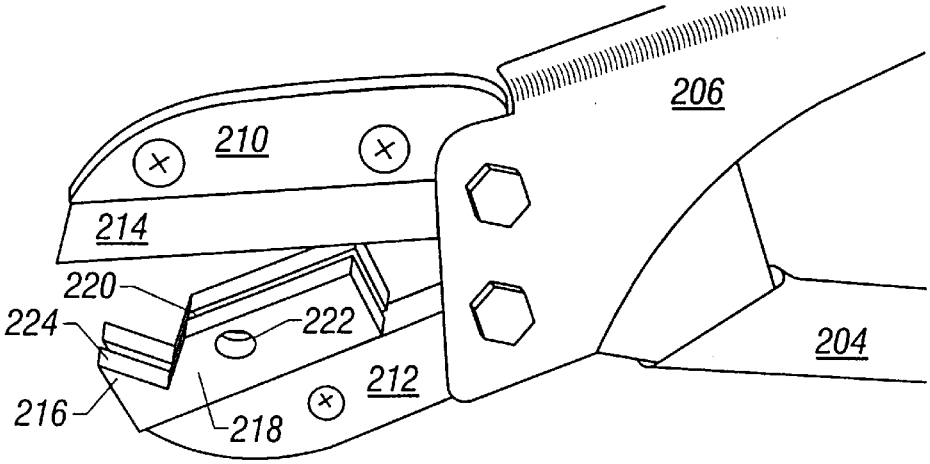

Referring to the drawings wherein like characters are used for like parts throughout the several views, FIGS. 2A and 2B illustrate a cutter 200 which comprises a plier 202 having a first handle 204 that is pivotally coupled to a second handle 206 by fasteners 208, e.g., pins. The plier 202 preferably is spring loaded, i.e., a spring mechanism (not shown) normally biases the handles 204 and 206 away from each other. In this way, force need only be exerted to pivot the handles toward each other. The action of the spring or other biasing mechanism pivots the handles away from each other. A first jaw 210 is formed on the first handle 204 and a second jaw 212 is formed on the second handle 206. Thus, as the handles 204 and 206 are pivoted, the first jaw 210 and the second jaw 212 pivot relative to each other. The plier 202 may be a commercially available plier, e.g., Sears 2.5 in. Handi-Cut™ plier.

A blade 214 is mounted on the first jaw 210 and an anvil 216 is mounted on the second jaw 212. The anvil 216 includes a block 218 which has a groove 220 at its upper end. The groove 220 is arranged to receive the blade 214 when the jaws 210 and 212 are pivoted towards each other. For safe transportation of the cutter 200, the hook 221 on the handle 206 may engage the handle 204 so that the blade 214 mates with the groove 220. An aperture 222 is provided in the block 218 for receiving a cord. The aperture 222 runs across the width of the groove such that when the blade 214 is received in the groove 220, the blade 214 also passes through the aperture 222. The anvil 216 supports the cord during cutting and provides a positive stop for the first jaw 210. The upper end of the block 218 includes a slot 224 that also may receive a cord. The slot 224 extends across the width of the groove 220 and allows for cord to be cut quickly without having to feed the cord through a closed hole, e.g., aperture 222.

Figure 3:
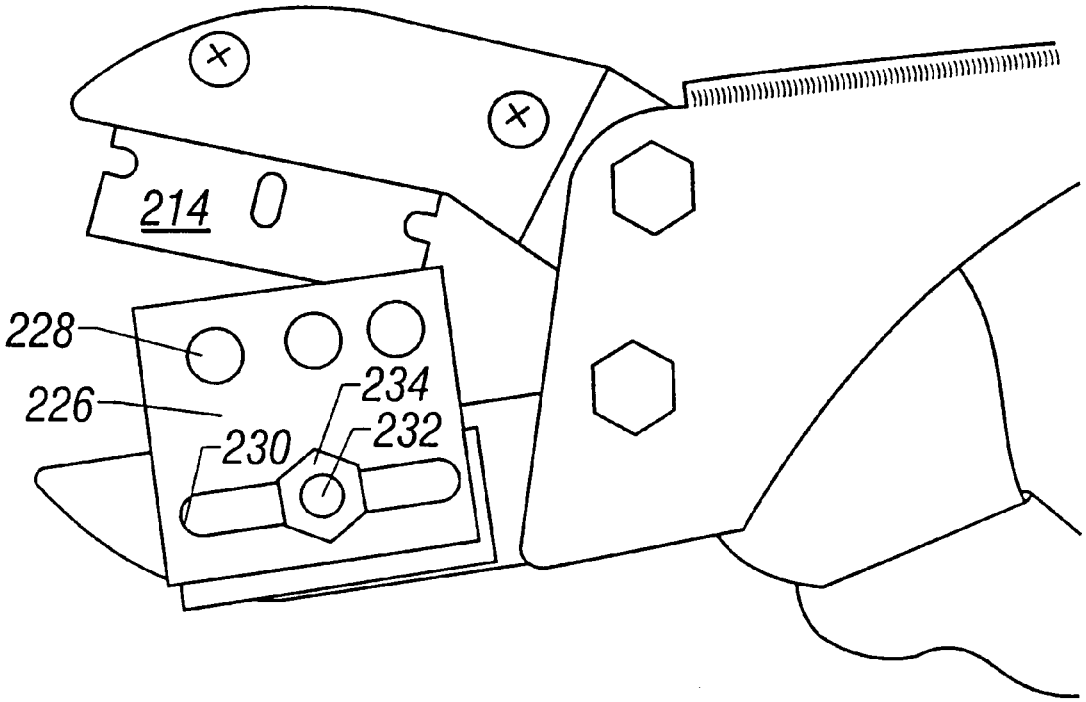
FIG. 3 illustrates another embodiment of a cord cutter.

Referring to FIG. 3, an alternate anvil 226 is shown. The anvil 226 is mounted on the second jaw 212 and includes a groove (not shown) for receiving the blade 214. As shown, the anvil 226 has a plurality of apertures 228 which run across the width of the groove for receiving the blade 214. This allows multiple cords to be cut with a single pass of the blade 214. The anvil 226 includes a mounting slot 230. A screw 232 extends through the second jaw 212 and the slot 230 and is secured in place by a nut 234. The mounting slot 230 allows for adjustment of the position of the anvil 226 on the second jaw, thus making it possible for the anvil to be positioned properly with respect to the blade to achieve efficient cutting of cords received in the apertures 228. Of course, other means of adjustably mounting the anvil on the second jaw may also be employed.

Figure 4A:
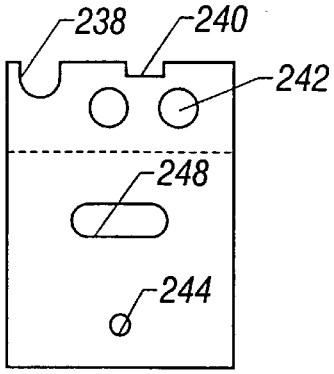
FIG. 4A shows a cord cutter anvil.
Figure 4B:
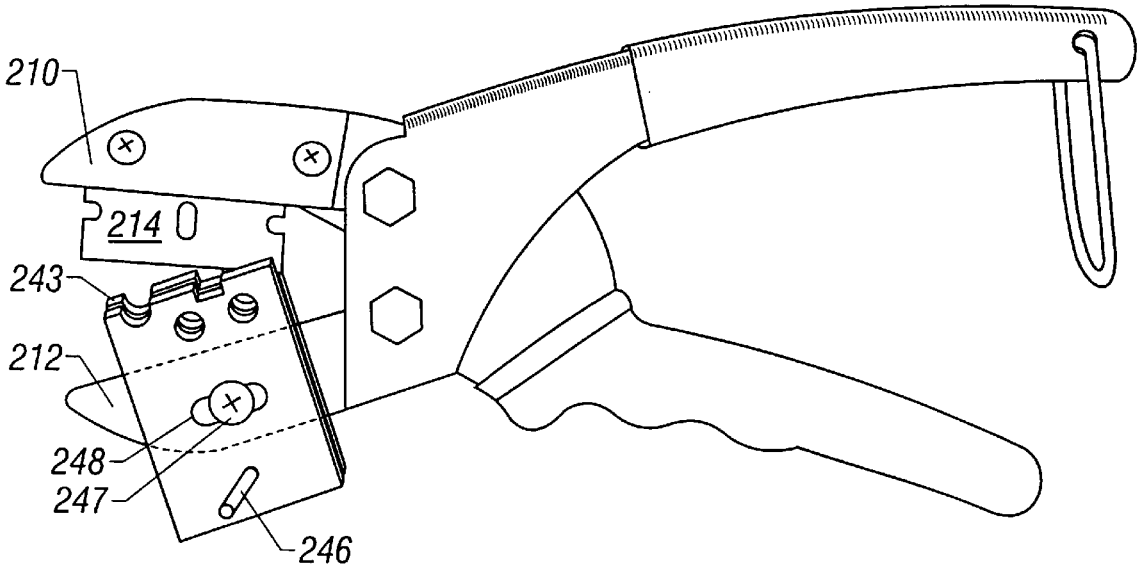
FIG. 4B illustrates another embodiment of a cord cutter employing the cord cutter anvil of FIG. 4A.

Referring to FIGS. 4A and 4B, an alternate anvil 236 is shown. The anvil 236 is similar to the anvils 216 and 226. The anvil 236 includes a groove 238 for quick cuts of cords, a slot 240 for cutting a ribbon cord, and apertures 242 for cord support and for precise cutting of cords. The anvil 236 includes a groove 243 for receiving the blade 214. As in the previously illustrated embodiments, the groove 243 intersects the groove 238, the slot 240, and the apertures 242 to allow the blade 214 to cut cords received in the groove 238, the slot 240, and the apertures 242. The anvil 236 also includes an aperture 244 through which a gage rod 246 can be inserted to allow accurate repeatable measurements of the cord to be made before cutting. The anvil 236 is mounted on the second jaw 212 by inserting a screw 247 through the mounting slot 248 and the second jaw 212 and securing the screw in place.

The anvil is made of a durable material, e.g., metal or hard plastic. The blade 214 may be coated with a wear-resistant material, such as boron carbide. Boron carbide increases the hardness of the cutting surface of the blade, resulting in less wear of the blade per cut. Boron carbide also reduces the friction forces during cutting. This has the effect of reducing the force required to cut the cord and allows for a more controlled and accurate cut. The spring-loading in the plier 202 provides the mechanical advantage needed to make multiple cord cuts quickly and efficiently.

While the invention has been described with respect to a limited number of embodiments, those skilled in the art will appreciate numerous variations therefrom without departing from the spirit and scope of the invention. For example, the blade and anvil may be shaped differently to reduce the required cutting force and to improve the blade life. The blade may also be coated with other types of wear-resistant coatings that reduce friction and extend blade life.

What is claimed is:

1. A cord cutter, comprising:

a first jaw and a second jaw pivotable relative to each other;

an anvil mounted on the second jaw, the anvil having a first opening for receiving a cord and a second opening intersecting with the first opening;

a blade coated with a wear-resistant material mounted on the first jaw, the blade having a cutting edge arranged to slide into the second opening when the first jaw and the second jaw are pivoted toward each other; and a gage rod for measuring the length of the cord, the gage rod being insertable into an aperture in the anvil.

2. The cord cutter of claim 1, wherein the wear-resistant material is boron carbide.

3. A cord cutter, comprising:

a first jaw and a second jaw pivotable relative to each other;

an anvil mounted on the second jaw, the anvil having a first opening for receiving a cord and a second opening intersecting with the first opening;

a blade mounted on the first jaw, the blade having a cutting edge arranged to slide into the second opening when the first jaw and the second jaw are pivoted toward each other, wherein the anvil provides a positive stop for the blade as the first and second jaws are pivoted toward each other; and a gage rod for measuring the length of the cord, the gage rod being insertable into an aperture in the anvil.

4. The cord cutter of claim 3, wherein the first jaw is formed on a first handle and the second jaw is formed on a second handle.

5. The cord cutter of claim 4, wherein the first and second handles are pivotally coupled and operable to pivot the first jaw and the second jaw relative to each other.

6. The cord cutter of claim 5, wherein the first handle and second handle are normally biased away from each other.

7. The cord cutter of claim 3, wherein the anvil further comprises one or more additional openings intersecting with the second opening and adapted to receive a cord.

8. The cord cutter of claim 3, wherein the anvil provides a positive stop for the first jaw.

9. A cord cutter, comprising:

a spring-loaded plier having a first jaw and a second jaw pivotable relative to each other;

an anvil mounted on the second jaw, the anvil having at least a first opening for receiving a cord and a second opening intersecting with the first opening;

a blade mounted on the first jaw, the blade having a cutting edge arranged to slide into the second opening when the first jaw and second jaw are pivoted toward each other, wherein the anvil provides a positive stop for the blade as the first and second jaws are pivoted toward each other; and a gage rod for measuring the length of the cord, the gage rod being insertable into an aperture in the anvil.

10. A cord cutter, comprising:

a plier having pivotally coupled first and second handles;

a first jaw formed on the first handle and a second jaw formed on the second handle;

an anvil mounted on the second jaw, the anvil having at least a first opening for receiving a cord and a second opening intersecting with the first opening;

a gage rod for measuring the length of the cord, the gage rod being insertable into an aperture in the anvil; and a blade mounted on the first jaw, the blade having a cutting edge arranged to slide into the second opening;

wherein the first handle and the second handle are operable to pivot the first jaw and the second jaw relative to each other, the cutting edge is slidably received in the second opening when the first jaw and the second jaw are pivoted towards each other, and the anvil provides a positive stop for the blade as the first and second jaws are pivoted toward each other.

* * * * *